United States Patent [19]

Pirro et al.

[11] 3,963,903

[45] June 15, 1976

[54] RESETTABLE COUNTING MECHANISM

[75] Inventors: Dominick Anthony Pirro, Avon; Paul Levere Kennedy, Meriden, both of Conn.

[73] Assignee: Veeder Industries, Inc., Hartford, Conn.

[22] Filed: Apr. 14, 1975

[21] Appl. No.: 567,489

[52] U.S. Cl. ..... 235/144 R; 235/1 C; 235/92 C; 235/131 FD

[51] Int. Cl.[2] ..... G06C 15/42; G06C 25/02

[58] Field of Search ..... 235/1 C, 130 R, 131 FD, 235/144 SM, 144 S, 144 R, 144 PN, 140

[56] References Cited

UNITED STATES PATENTS

| | | | |
|---|---|---|---|
| 1,311,173 | 7/1919 | Mann | 235/131 FD |
| 2,331,884 | 10/1943 | Bliss | 235/131 FD |
| 2,444,570 | 7/1948 | Lawrence et al. | 235/144 S |
| 2,494,955 | 1/1950 | Mayer et al. | 235/144 S X |
| 2,636,680 | 4/1953 | Summers | 235/131 FS X |
| 3,471,085 | 10/1969 | Soupenne | 235/144 S |
| 3,576,974 | 9/1969 | Knox | 235/92 C |

*Primary Examiner*—Edith Simmons Jackmon
*Attorney, Agent, or Firm*—Prutzman, Hayes, Kalb & Chilton

[57] ABSTRACT

A low cost resettable counting mechanism comprising an electromagnetic indexing mechanism and a counter stepped by the indexing mechanism having three-piece higher order number wheels with respective unitary molded plastic reset and drive pawl members for connecting the number wheels for counting and resetting purposes. A detent arm integrally formed with the number wheel shaft engages a recess in the counter viewing crystal to hold the countershaft against rotation during counting and the counter shaft is manually rotatable for resetting the higher order number wheels. A clapper and plastic verge of the indexing mechanism interfit to retain them in assembled relationship.

11 Claims, 6 Drawing Figures

FIG. 3
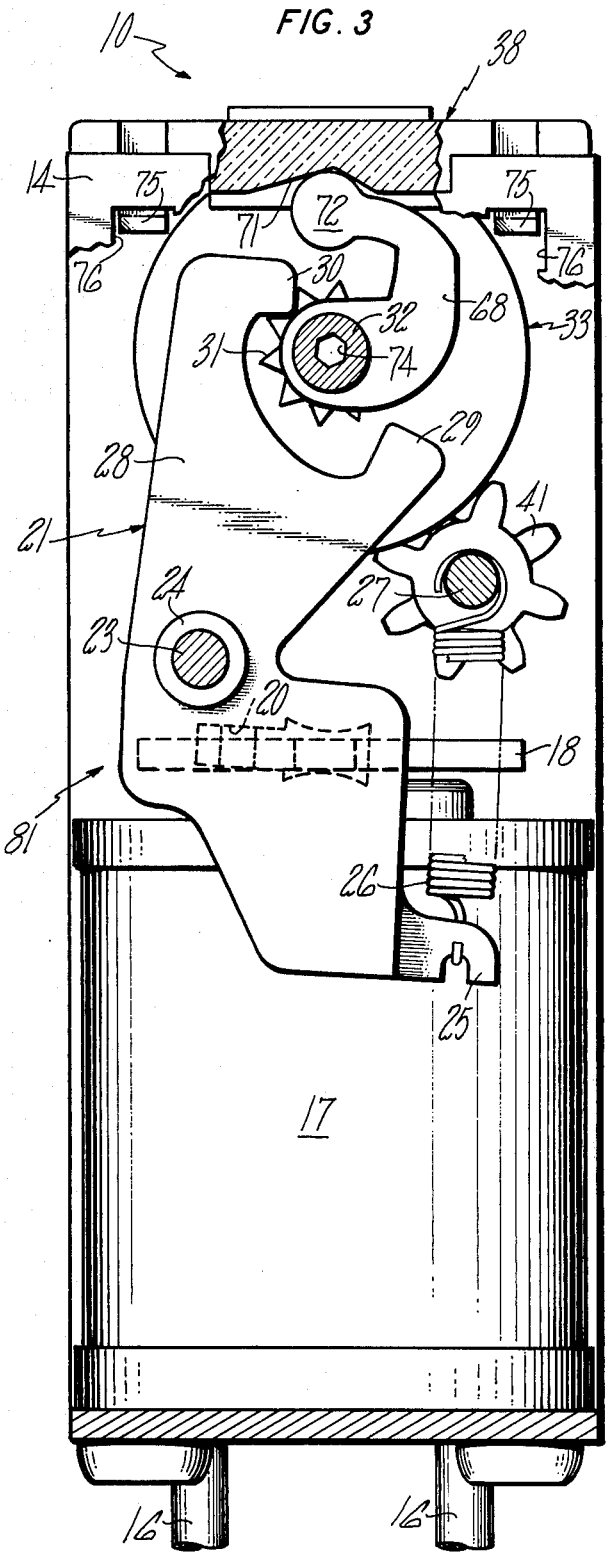
FIG. 4
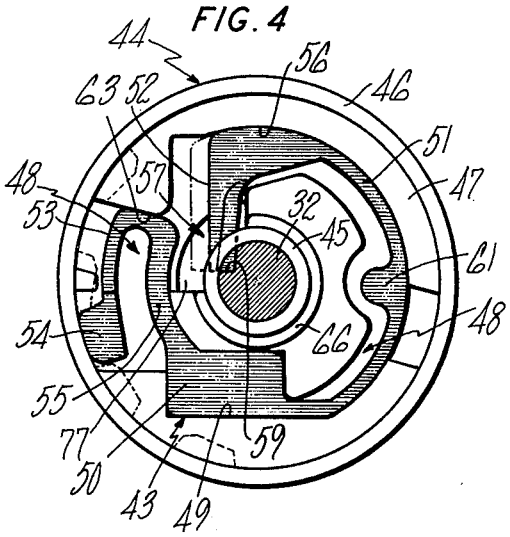
FIG. 5
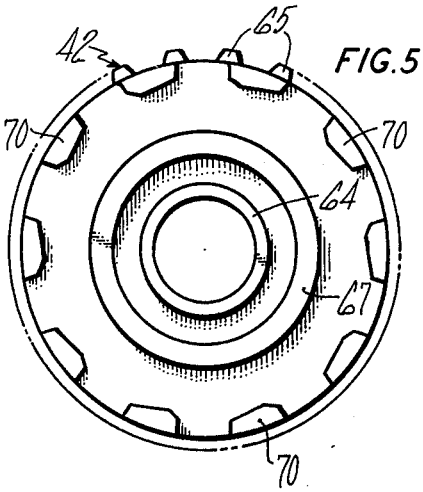
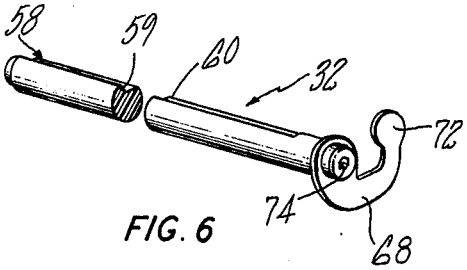
FIG. 6

RESETTABLE COUNTING MECHANISM

SUMMARY OF THE INVENTION

The present invention relates to a new and improved resettable counting mechanism.

It is a principal object of the present invention to provide a new and improved resettable counting mechanism having an economical construction and a minimum number of parts designed to facilitate economical and rapid assembly.

It is a further object of the present invention to provide a new and improved resettable counting mechanism which is adapted for low-cost mass production.

It is a still further object of the invention to provide a new and improved resettable counting mechanism of the type which is electromagnetically actuated.

It is another object of the present invention to provide a new and improved resettable counting mechanism having an inexpensive and reliable resetting mechanism.

It is still another object of the present invention to provide a new and improved resettable counting mechanism having resettable number wheels of low-cost construction.

It is another object of the present invention to provide a new and improved resettable counting mechanism having a few parts permitting easy assembly.

It is an even further object of the present invention to provide a new and improved resettable counting mechanism having a wheel indexing mechanism which is easily positioned and maintained in position within the mechanism frame.

Other objects will be in part obvious and in part pointed out more in detail hereinafter.

A better understanding of the invention will be obtained from the following detailed description and the accompanying drawings of an illustrative application of the invention.

BRIEF DESCRIPTION OF THE DRAWINGS

In the drawings:

FIG. 3 is a side elevation sectional view of the counting mechanism, partly broken away and partly in section, taken substantially along line 3—3 of FIG. 2 and showing a number wheel shaft detenting mechanism;

FIG. 4 is an enlarged partial longitudinal sectional view of the counting mechanism showing an indicia wheel thereof;

FIG. 5 is an enlarged side view of a drive gear of the counting mechanism; and

FIG. 6 is an isometric view, partly broken away and partly in section, of a number wheel shaft of the counting mechanism.

DESCRIPTION OF THE PREFERRED EMBODIMENT

Figure 1:
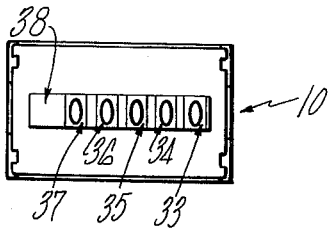
FIG. 1 is a front elevation view of a counting mechanism incorporating the features of the invention.

Referring now to the drawings wherein like reference numerals indicate like parts throughout the several figures, the invention is depicted as embodied within a resettable electromagnetic counting mechanism generally designated 10. The counting mechanism 10 is typically of the type employed in copying machines for recording the number of copies made by the machine, though its application is not limited thereto. The counting mechanism 10 includes a generally U-shaped frame 12, an electromagnet 17 connected to the rear of the frame, a counter 80 mounted toward the front end of the frame, a crystal 38 removably mounted across the front of the frame, and a counter drive mechanism 81 mounted at one side of the frame. The frame 12 has two spaced parallel side arms 13, 14 joined by a rear nexus member 15 and may be of integral construction. The side arms 13, 14 of the frame 12 are preferably resiliently separable from one another sufficiently to accommodate mounting the various other elements of the counting mechanism therebetween. The electromagnet 17 is mounted on the frame nexus 15 and electrical leads 16 are connected to the electromagnet for applying count advancing electrical signals thereto. The electromagnet 17 is operative to actuate the counter drive mechanism 81 which in turn drives the lowest order number wheel 33 in the counter 80, thereby advancing the counter.

The drive mechanism 81 comprises a clapper 18, a verge 21 and a return tension spring 26. The verge 21, preferably of molded plastic, is pivotally mounted on a shaft 23 extending between the frame arms 13, 14 and arm 28 has a pair of spaced drive pawls 29, 30 for stepwise engagement with and advancement of a star wheel 31 connected to the lowest order number wheel 33 as the verge is pivoted back and forth. The clapper 18 is pivotally mounted at one end in a slot 19 in the side arm 13 and at the other end in a recessed seat 20 in the verge 21. The clapper 18 extends generally transversely of the frame 12 and a tang 22 at one end extends into the slot 19 to permit forward and back pivoting of the clapper thereabout. The tang 22 is necked down to provide longitudinal support of the clapper 18 by the frame arm 13. Seating of the clapper 18 in the seat 20 is maintained by a thrust bearing member, or hub, 24 which encircles the shaft 23 and extends axially outward from the verge 21 into engagement with the inner face of the frame arm 14. The hub 24 is formed integrally with the verge 21 and its length, coupled with that of the clapper 18 in opposition, is effective to axially position the verge on the shaft 23.

The tension spring 26 extends between a tab 25 on the verge 21 and a pinion shaft 27 supported by the frame arms 13, 14 forward of the tab 25. The spring 26 biases the clapper 18 away from the electromagnet 17. Energization of the electromagnet 17 by a count advancing electrical signal draws the clapper 18 pivotally toward it, thereby pivoting the verge 21 and advancing the wheel 33 by one-half step. When the electromagnet 17 is de-energized, the spring 26 pivotally returns the clapper 18 and the verge 21 to their normal positions, thereby advancing the wheel 33 by the remaining one-half step.

The counter 80 includes the lowest order wheel 33 and several consecutively higher order wheels 34, 35, 36 and 37 respectively, all rotatably mounted on the shaft 32 in a conventional manner and respectively driven by multilated-tooth transfer pinions 41, one between each pair of adjacent number wheels and rotatably mounted on the pinion shaft 27. The wheel shaft 32 is preferably molded of plastic, is rotatably supported at opposite ends by the frame arms 13, 14 and is normally detented by an arm 68 integrally formed with the shaft 32 and which releasably engages a notch 71 in the crystal 38. The lowest order wheel 33 is of molded plastic and the star wheel 31 is preferably integrally molded therewith. Each of the wheels 33–37 has indicia on the outer cylindrical surface thereof to provide a count readout through the crystal 38.

The number wheels 33–36 have conventional transfer gear segments 40 for indexing the adjacent higher order wheels respectively in the conventional manner. Each number wheel 33–36 axially overlaps part of the transfer pinion 41 associated with it to form a transfer pinion locking ring. Each number wheel 34–37 includes wheel drive gears 42 or 42' for engagement with the transfer pinions 41, with the drive gears 42' associated with the wheel 34 being integrally molded therewith of plastic. The higher order number wheels 35–37, to be described in greater detail, are also of molded plastic but comprise a three-part assembly. The unitary, lower order number wheels 33 and 34 essentially remain in connected relationship with one another through their transfer pinion 41, and the wheel 33 is connected to the verge 21 through engagement between the star wheel 31 and the drive pawl 29 or 30, thus making the wheels 33 and 34 non-resettable.

Figure 2:
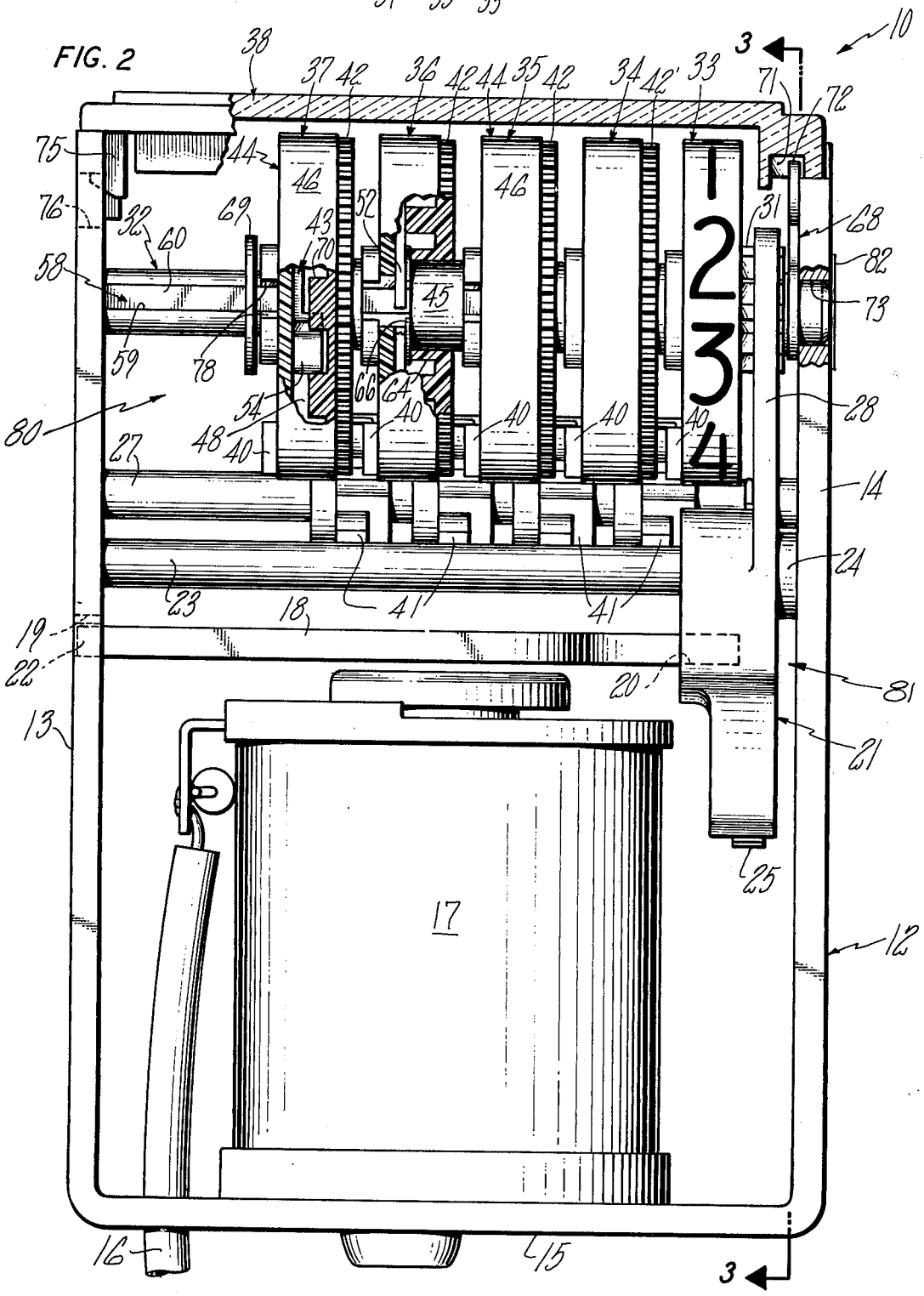
FIG. 2 is an enlarged bottom plan view, partly broken away and partly in section, of the counting mechanism of FIG. 1.

The three higher order wheels 35–37 are, however, resettable and each comprises a three-part assembly including a drive gear 42, a combined reset pawl and drive pawl member 43, and an indicia wheel 44, seen most clearly in FIGS. 2, 4 and 5. The indicia wheel 44 is of molded plastic and includes a central hub 45, a radially outer rim 46 bearing the indicia and an intermediate generally annular rim-supporting web 47. The hub 45 extends beyond both ends of the rim 46 and the web 47 to establish the desired axial spacing between adjacent wheels for the transfer pinions 41 and, additionally, to provide a support or bearing for the drive gear 42. The wheels 33, 34 include similar hubs to provide the requisite spacing for the pinions 41.

The wheel web 47 provides connecting support for the rim 46 and is generally located at the side of the rim axially toward the next-higher order wheel. A generally annular region 48 of the surface of the web 47 facing the lower order wheels is axially recessed for defining support surfaces which radially or angularly engage and/or abut the drive and reset pawl member 43.

The reset and drive pawl member 43, hereinafter pawl member 43, is a unitary, generally arcuate, relatively thin, plastic member which includes a generally rectangular mounting portion 50, a semi-circular leaf spring 51 connected at one end to one region of the mounting portion and including a reset pawl 52 extending generally radially inward from its other end, and another generally arcuate leaf spring 53 connected at one end to another region of the mounting portion and including a drive pawl 54 extending axially of and radially outward from its other end. The mounting portion 50 includes a short arcuate arm 55 extending therefrom oppositely of the leaf spring 51, and the leaf spring 53 extends from the end of the arm 55, first radially outwardly a short distance and then arcuately generally parallel to the arm in the reverse direction such that it extends therefrom in the same direction as the spring 51 but is angularly displaced therefrom.

The recessed region 48 in the web 47 is contoured to provide a generally rectangular mounting seat 49 closely embracing the sides of the mount 50 thereby to position the pawl member 43 within the indicia wheel 44. The recess 48 also defines an arcuate generally radially inwardly facing combination supporting, locating and guiding surface 56 having a contour which substantially follows the natural contour of the leaf spring 51 radially outward therefrom and adjacent thereto over most of its length and which may be in contact with the spring at and near its end remote from the mount 50.

An arcuate opening 57, of about 90° in angular extent, extends radially through the hub 45 axially adjacent the web 47 to provide access to the shaft 32 from the recess 48. The reset pawl 52 extends inwardly from the spring 51 at its end remote from the mount 50 in a direction which is substantially radially of the natural curvature of the spring and of the axis of the shaft 32. The pawl 52 normally extends inward through the opening 57 for detenting engagement with a slot 58 in the shaft 32. An arcuate opening 77 extending axially through the web 47 of each indicia wheel 44 and a similar arcuate opening 78 in the hub 45 on the higher order side of each wheel are angularly aligned with the opening 57, and exist to facilitate the wheel molding process.

The slot 58 in the shaft 32 extends longitudinally thereof at least along that length of the shaft which supports the resettable number wheels 35–37 and is defined by a pair of surfaces 59, 60 disposed at 90° to one another, each extending a short distance into the shaft and at least one being offset from the radial. Similarly, the slot engaging face of the pawl 52 comprises two surfaces oriented at 90° to one another for contact with the slot surfaces 59 and 60. The slot 58 is angularly positioned on the shaft 32 to effect a resetting of the number wheels 35–37, as will be later described.

The guide surface 56 in the indicia wheel 44 is generally radially adjacent the pawl-bearibg end of the spring 51 and provides an abutment for non-yieldingly engaging the spring and pawl 52 when the surface 59 of the slot 58 engages the pawl in facing opposition in one direction of rotation of the shaft 32 relative to the indicia wheel. The recess 48, and accordingly the surface 56, extend angularly beyond the end of the spring 51 and the pawl 52 a sufficient distance to allow displacement of the pawl 52 out of detenting engagement when contacted by the other surface 60 of the shaft 32 in the opposite direction of rotation of the shaft relative to the indicia wheel 44. This displacement of the pawl 52 occurs in a direction generally determined by the contour of the surface 56 and is effective to permit the pawl to be moved to the outer periphery of the shaft 32, as depicted in phantom in FIG. 4. In this embodiment, the surface 56 recedes from the shaft 32 allowing the pawl 52 to follow, however, it will be appreciated that even if the surface were constantly spaced from the shaft, it would be possible to displace the pawl into and out of detenting engagement with the shaft. Displacement of the pawl 52 by the shaft 32 is effective to load the spring 51 such that the pawl is adapted to be returned by the spring to its normal position shown in full lines in FIG. 4 to permit detenting engagement with the shaft. An ejector pad 61 on the thin spring 51 is provided to facilitate ejection of the spring 51 from a mold following its formation by molding.

The recess 48 is also contoured to accommodate the spring 53 and the drive pawl 54 and defines a stop or abutment 63 for angular facing engagement with the radially extending root portion of the leaf spring 53. The abutment 63 extends inwardly, substantially radially, from the rim 46 to provide an angular facing surface for receiving, through the pawl 54 and the spring 53, a unidirectional driving force applied by the drive gear 42. The abutment 63 aids in positioning the pawl 54 for receiving the driving force. The geometry of the leaf spring 53 relative to the indicia wheel 44 is such that the drive pawl 54 is urged radially outward normally toward the rim 46, and the base of the spring 53 is positioned in proximity or contact with the abutment 63.

Referring to FIGS. 2 and 5, the wheel drive gear 42 is of molded plastic and includes a central hub 64 coaxially encircling and supported by the hub 45 for rotation of the gear relative to the indicia wheel 44. The gear 42 includes the conventional teeth 65 positioned about its circumference for engagement with a transfer pinion 41. The gear hub 64 extends axially toward the web 47 of the indicia wheel 44 and axially engages the segmental annular bearing surface 66. The bearing surface 66 is an axially raised integral portion of the indicia wheel 44 and closely encircles the hub 45 except for a discontinuous 90° arc segment in angular alignment with the opening 57. The bearing surface 66 is located axially between the opening 57 and the hub 64 to prevent binding contact between the gear 42 and the reset pawl 52. The gear 42 includes a second annular, axially extending portion, a retainer 67, which is positioned radially for alignment with the mounting portion 50 of the pawl member 43. The retainer 67 extends axially to a position closely adjacent the pawl member 43 to retain it axially seated in the mounting seat 49 but is normally prevented from contacting the member by the contact of the hub 64 with the bearing surface 66. This latter contact, or near contact, is obtained by placing the several wheels 33–37 and their component parts in close axial proximity and is maintained by limits at opposite ends of the set of number wheels, in this instance the detent arm 68 and a locking ring 69.

The drive gear 42 has ten equiangularly spaced driving lugs 70 extending axially into the indicia wheel 44. The lugs 70 act through the drive pawl 54 to unidirectionally impart rotary motion from the pinion 41 to the indicia wheel 44, in the clockwise direction as viewed in FIG. 4. The lugs 70 are positioned in angular drive alignment with the drive pawl 54, but do not contact the indicia wheel 44. The lugs 70 are contoured to provide a surface for contacting the pawl 54 and urging it and the spring 53 respectively against the wheel rim 46 and the abutment 63 in the count advancing direction of rotation of the gear 42 and to provide a surface for deflecting the pawl radially inwardly upon relative rotation of the indicia wheel 44 and gear in the opposite angular direction to enable the wheel 44 to be reset by the shaft 32, in the clockwise direction as viewed in FIG. 4.

The detent arm 68 has a generally U-shaped configuration and extends transversely of or normal to the shaft 32, with one end affixed to the shaft and the other end radially spaced therefrom and having a radially outward projecting circular lobe 72. The outer portion of the U-shaped detent arm 68 is sufficiently thin and narrow to permit some resilient inward radial displacement of the lobe 72 when sufficient force is applied. The frame arm 14 includes a circular opening 73 therethrough in which one end of the shaft 32 is supported, and the detent arm 68 is axially adjacent that frame arm in bearing contact therewith. The end of shaft 32 in the opening 73 is flush with the outer surface of the frame arm 14 and includes an axially extending hexagonal socket seat 74 for receiving a conventional hexagonally shaped wrench for manually rotating the shaft. the seat 74 may be covered by an anti-tamper seal 82, as shown in FIG. 2, for indicating and discouraging any unauthorized resetting of the counter with the shaft 32. The seal covers the opening 73 in the frame arm 14.

The crystal 38 abuts against the front end of the frame arms 13, 14 and includes connecting fingers 75 extending rearwardly and outwardly through openings 76 in the frame arms to hold the crystal in engagement with the frame 12. The frame arms 13, 14 exhibit a slight resiliency which allows the crystal fingers to be forced into and out of embracing engagement therewith. A notch 71 in the inside surface of the crystal is positioned for receiving the lobe 72 on the detent arm 68 and has a shallow V-shaped configuration, with the apex of the V extending forward. The notch 71 is effective to retain the lobe 72 and the arm 68 in detented engagement under the rotary forces occurring during normal counting operation. The relative angular positionings of the notch 71, the detent arm 68 on the shaft 32, the detent slot 48 in the shaft, and the reset pawl 52 are selected such that number wheels 35–37 may be reset to a zeroized setting with the shaft detented thereat.

Referring to the operation of the resettable counting mechanism 10, alternate energization and de-energization of the electromagnet 17 effects stepwise rotation of the star wheel 31 and accordingly the lowest order wheel 33 in a well-known manner. Upon a count of 10, the next higher order wheel 34 is stepped one step by a transfer pinion 41, as is well-known. Upon a count of 10 by the number wheel 34, it rotates its transfer pinion 41 to rotate the drive gear 42 one step or 36°. In this count advancing direction of rotation, the operative lug 70 of the drive gear 42 will simultaneously index the respective indicia wheel 44, 36° via the drive pawl 54 for each count advancing step of that wheel. The wheels 36 and 37 are advanced in essentially the same manner as the wheel 35.

From time to time, it will be desirable to reset the counter to a reference position. If the counting mechanism 10 is associated with copying apparatus, such resetting might occur as part of the scheduled maintenance for the apparatus. In such applications, it is not necessary that the two lowest order number wheels 33 and 34 be resettable. Instead, in order to reduce the cost of the counter, the wheels 33 and 34 are non-resettable and either the starting reference is permitted to be a count from one to 99 or alternatively, before resetting the electromagnet 17 is actuated a sufficient number of times to bring both lowest order wheels to a zero setting.

In order to reset the higher order wheels 35–37, an appropriate wrench or key is inserted into the socket seat 74 and rotated in the appropriate direction, in this instance clockwise, as viewed in FIGS. 3 and 4, for disengaging the detent arm 68 from the notch 71 and rotating the shaft 32 through one or more complete revolutions and back into detented engagement with the notch. During resetting rotation of the shaft 32, the number wheels 33 and 34 remain stationary. The drive gears 42 also remain stationary except for the final 36° of rotation, at which time, the transfer gear segments 40 on the wheels 35 and 36 allow the pinions 41 to step the drive gears for the wheels 36 and 37 by one step.

Most importantly, as the shaft 32 is rotated for resetting the higher order counter wheels 35–37, the detent slot 48, and more specifically the surface 59 thereof, is moved into detenting engagement with the reset pawls 52 of the indicia wheels 44 associated with the number wheels 35–37. This engagement connects the wheels 35–37 with the shaft 32 for final rotation to a zero display position at which the detent arm 68 is reengaged by the notch 71. In the opposite direction of relative rotation, as occurs when the shaft 32 is detented and the wheels 44 are advanced in count advancing rotation, the reset pawl 52 is deflected outwardly by the slot surface 60 and maintained in the deflected position by the shaft 32, thereby allowing continued rotation.

As will be apparent to persons skilled in the art, various modifications, adaptations and variations of the foregoing specific disclosure can be made without departing from the teachings of the present invention.

We claim:

1. In a resettable counting mechanism having a frame, a wheel shaft supported for resetting rotation relative to the frame and having a pawl-engaging slot therein, a set of coaxial number wheels rotatably mounted on said shaft in side-by-side ascending order for count advancing rotation in one direction of angular rotation, at least one of the higher order wheels including reset pawl means for detenting engagement with said slot in said shaft in one direction of angular rotation at a relative angular positioning corresponding with a zero reset position when said shaft is at its reset position, transfer pinions for transferring the count between adjacent number wheels, selectively actuable means for driving the lowest order wheel of said set; the improvement wherein said shaft includes a detenting member fixedly connected thereto and extending transversely thereof and a detent seat is operatively positioned and stationary relative to said frame for releasably retaining said detenting member and said shaft at the reset rotational position.

2. In the resettable counting mechanism of claim 1 wherein said detenting member is integrally formed with said shaft and comprises a generally U-shaped arm connected at one end to said shaft and having a lobe at the other end for retained contact with said detent seat.

3. The resettable counting mechanism of claim 1 including a viewing crystal supported by said frame and extending closely adjacent said number wheels, and said detent seat comprises a notch in said crystal.

4. The resettable counting mechanism of claim 1 wherein said shaft and detenting member are of molded plastic, said detenting member is resilient, and said notch is formed to releasably retain said detenting member therein.

5. The resettable counting mechanism of claim 1 wherein said wheel shaft includes a tool seat at one end for receiving a tool for resetting rotation, and an anti-tamper seal covers said tool seat thereby to indicate and discourage unauthorized resetting of the counter.

6. In a resettable counting mechanism having a frame, a wheel shaft supported for resetting rotation relative to the frame and having a slot therein, shaft detenting means for detenting said shaft at a reset rotational position relative to said frame, a set of number wheels coaxially mounted on said shaft in side-by-side ascending order for count advancing rotation relative thereto, a transfer pinion for transferring the count between each adjacent pair of number wheels, selectively actuable means for driving the lowest order wheel of said set; the improvement wherein at least one higher order number wheel is an assembly comprising a molded plastic indicia wheel having a hub and a rim and a web therebetween, said web having an axially recessed seat contoured to supportingly engage and position drive and reset pawl means and said hub having an opening radially therethrough; a drive gear adjacent said indicia wheel for driven rotary engagement with a said transfer pinion and including angularly spaced driving lugs extending axially toward said indicia wheel web; and a unitary plastic member including a mounting portion supportingly engaged and positioned by said seat in the web of said indicia wheel, a first leaf spring extending from the mounting portion and supporting a drive pawl in confronting relation with said driving lugs for unidirectional driven engagement thereby, and a second leaf spring extending from the mounting portion and supporting a reset pawl extending inward through said hub opening for detenting engagement with said shaft slot and for resilient deflection from said detenting engagement in respectively opposite directions of relative rotation of said shaft and indicia wheel.

7. In the resettable counting mechanism of claim 6 wherein said second leaf spring is arcuate, said reset pawl extends substantially radially inwardly therefrom and said web includes a substantially radially inwardly facing guide surface in compressive contact with part of said second leaf spring for urging said reset pawl into said detenting engagement with said shaft and allowing said resilient deflection out of said detenting engagement.

8. In the resettable counting mechanism of claim 6 wherein said web is contoured to provide first and second abutments, said first abutment positioned for unidirectional angular force-transmitting engagement with said drive pawl and said second abutment positioned for angular force-transmitting engagement with said reset pawl positioned in said detenting engagement with said shaft slot.

9. In the resettable counting mechanism of claim 6 wherein said drive gear encircles and is radially supported by the hub of said indicia wheel and includes a surface in close axial proximity with at least the mounting portion of said member thereby to maintain it in supported engagement within said seat in the web of said indicia wheel.

10. In a resettable counting mechanism having a frame, a plurality of number wheels mounted on the frame for relative counting and resetting rotation, means for rotating at least some of said wheels to a reset position, a drive wheel connected in driving relation with the lowest order number wheel, a verge in driving engagement with said drive wheel and pivotally mounted on a shaft supported by said frame, a clapper pivotally supported at one end by said frame and engaging said verge substantially axially at the other end for pivoting said verge to drive said drive wheel in response to pivoting of said clapper, means including a selectively energizible electromagnet operatively positioned to effect said pivoting of said clapper; the improvement wherein said verge is of molded plastic and includes a recessed seat in one side thereof for receiving said other end of said clapper and an axially extending thrust bearing member on the opposite side of said verge in axial engagement with said frame, said thrust bearing member having a length sufficient to maintain said clapper seated in said verge recess.

11. In a resettable counting mechanism having a frame; a counter in the frame including a wheel shaft supported for resetting rotation relative to the frame and having a pawl-engaging slot therein, shaft detenting means for detenting said shaft at a reset position relative to the frame, a plurality of number wheels mounted on said shaft in side-by-side ascending order for unidirectional count advancing coaxial rotation relative thereto, a drive wheel connected in driving relation with the lowest order number wheel, at least one of the higher order wheels including reset pawl means for unidirectional detenting engagement with the slot in the shaft at a relative angular positioning corresponding with a zero position when the shaft is at the said reset position, and transfer pinions for transferring the count between adjacent number wheels; a drive mechanism including a verge pivotally mounted on a shaft supported by the frame and in driving engagement with the drive wheel, and a clapper pivotally supported at one end by the frame and its other end engaging the verge substantially axially for pivoting the clapper; and means including an electromagnet supported by the frame for selectively pivoting the clapper; the improvement wherein each said at least one higher order number wheel is an assembly comprising a molded plastic indicia wheel having a hub and rim and connecting web, a drive gear, and a unitary plastic reset and drive pawl means, said pawl means having first and second arcuate leaf springs extending from a mounting portion and respectively supporting a radially outwardly and axially extending drive pawl and a substantially radially inwardly extending reset pawl at their remote ends, said wheel hub extending axially beyond said web and having an opening radially therethrough for extension of said reset pawl radially inward therethrough, said wheel web having an axially recessed seat defining pawl means support, locating and guiding surfaces for embracing the pawl means mounting portion, for urging the reset pawl into and allowing resilient deflection out of detenting engagement with the shaft slot in opposite directions of relative rotation of the shaft and wheel, and for providing first and second abutments respectively positioned for unidirectional angular force-transmitting engagement with said drive pawl and for angular force-transmitting engagement with said reset pawl positioned in said detenting engagement with said shaft slot, said drive gear radially encircling and supported by said indicia wheel hub for driven rotary engagement with a transfer pinion and including angularly spaced driving lugs extending axially toward said indicia wheel in angular confronting relation with said drive pawl for unidirectionally transmitting a rotational drive force to said indicia wheel through said first abutmemt; a viewing crystal supported by the frame closely adjacent the number wheels and including a detent notch therein, the shaft detenting means comprise a molded plastic member formed integrally with the number wheel shaft and including a U-shaped arm extending transversely of and connected at one end to the shaft and having a lobe at the other end for resilient releasable detenting engagement with said crystal in said detent notch; the number wheel shaft includes a tool seat at one end for receiving a tool for detent releasing and resetting rotation, said frame includes a mount opening in which said end of said shaft having said tool seat is rotatably supported, and a tamper-proof seal on said frame covers said mount opening and said tool seat thereby to prevent unauthorized resetting of the counter; and the verge is of molded plastic and includes an axially recessed seat in one side for receiving the end of the clapper and an axially extending thrust bearing member on the other side in axial engagement with the frame to maintain the clapper seated in said verge seat.

* * * * *